United States Patent [19]

Lee et al.

[11] Patent Number: 4,929,956

[45] Date of Patent: May 29, 1990

[54] OPTICAL BEAM FORMER FOR HIGH FREQUENCY ANTENNA ARRAYS

[75] Inventors: Jar J. Lee, Irvine; Huan-Wun Yen, Westlake, both of Calif.

[73] Assignee: Hughes Aircraft Company, Los Angeles, Calif.

[21] Appl. No.: 246,394

[22] Filed: Sep. 10, 1988

[51] Int. Cl.[5] ..... H01Q 3/00

[52] U.S. Cl. ..... 342/376; 342/54

[58] Field of Search ..... 342/376, 157, 158, 54, 342/175; 343/753, 909, 910, 911 R; 350/96.13

[56] References Cited

U.S. PATENT DOCUMENTS

| | | |
|---|---|---|
| H57 | 5/1986 | Gabriel et al. . |
| 3,878,520 | 4/1975 | Wright et al. . |
| 4,028,702 | 6/1977 | Levine . |
| 4,268,831 | 5/1981 | Valentino et al. . |
| 4,571,591 | 2/1986 | Valentino et al. . |
| 4,721,966 | 1/1988 | McGrath . |
| 4,739,334 | 4/1988 | Soref . |

OTHER PUBLICATIONS

T. R. Joseph et al, "Applications of Microwave Fiber Optic Links", Antennas and Propagation, vol. 1, Jun. 15–19, 1987, pp. 422–425.

J. McFarland et al, "Multiple-Beam Constrained Lens", Microwaves, Aug. 1963, pp. 82–89.

*Primary Examiner*—Theodore M. Blum

*Attorney, Agent, or Firm*—V. D. Duraiswamy; P. M. Coble; W. K. Denson-Low

[57] ABSTRACT

A wideband, true time delay antenna beamforming network 10 for millimeter wave phased array antennas is disclosed herein. The beamforming network 10 of the present invention includes a laser 30 for generating a beam B of electromagnetic energy. The beamforming network 10 further includes an electro-optic modulator 40 for modulating the beam B in response to an input signal S modulated about a first frequency $f_o$. A first antenna array 80 generates a first electromagnetic field pattern P by radiating the modulated beam B′ in a first direction. The present invention further includes a constrained lens 90 for receiving the first field pattern P and for emitting an antenna driver feed beam F in a second direction in response thereto. An antenna array driver 115 electro-magnetically coupled to the constrained lens 90 by the feed beam F provides a set of signals modulated about the first frequency $f_o$ to drive an antenna array 20.

18 Claims, 2 Drawing Sheets

FIG. 2
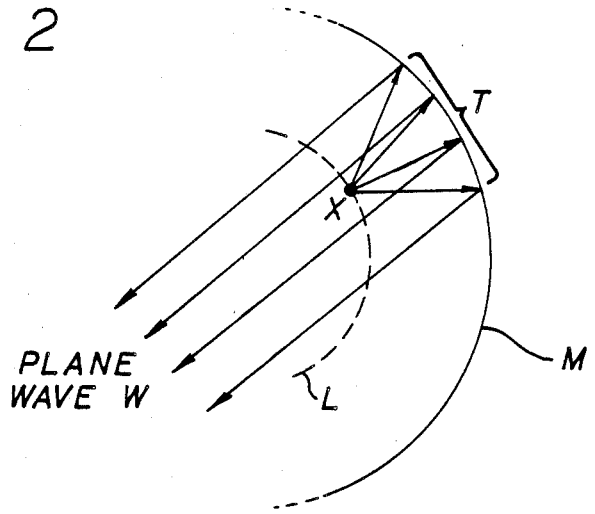
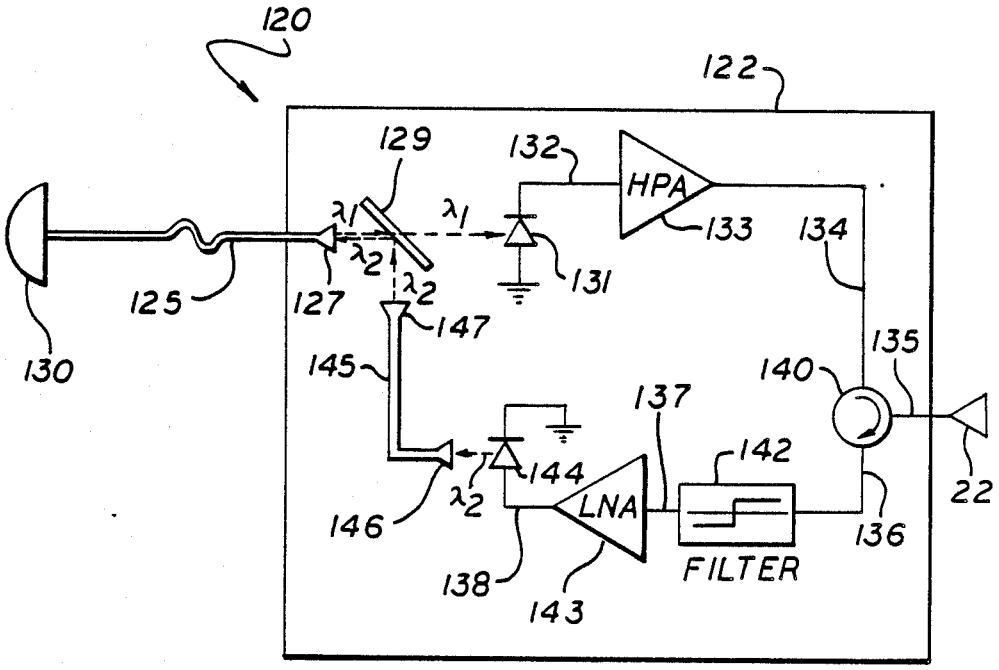
FIG. 3

OPTICAL BEAM FORMER FOR HIGH FREQUENCY ANTENNA ARRAYS

This invention was made with Government support under Contract F30602-87-C-0014 awarded by Rome Air Development Center, Griffiss Air Force Base, New York. The Government has certain rights in this invention.

BACKGROUND OF THE INVENTION

1. Field of the Invention:

The present invention relates to antenna systems. More specifically, the present invention relates to antenna beamforming networks for phased array antenna systems.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art:

Many millimeter wave radar and communication systems require wide bandwidth antennas. In addition, in certain conventional wideband millimeter wave systems a scanning beam is generated by an antenna mounted on a gimballed dish. Unfortunately, the mechanical scan effected by gimballed dish systems is relatively slow. Further, gimballed dish systems typically cannot simultaneously support multiple scanning beams.

In submillimeter wave applications scanning phased array antenna systems offer improved beam switching rates relative to gimballed dish systems. Further, beamforming networks in phased array systems allow these systems to provide multiple scanning beams. Within the beamforming network, a master signal is typically divided and sequentially shifted in phase by an array of phase shifting elements (phase shifters).

In such systems, the direction of the emitted beam varies with respect to changes in operating frequency. Thus, beamforming networks utilizing phase shifters are generally not well suited for wideband applications as a single beam direction can only support a limited frequency spectrum.

Further, the large signal loss (over 10 dB in certain applications) of millimeter wave phase shifters discourages the use of millimeter wave phase shifters even in relatively narrowband millimeter wave beamforming networks. Accordingly, the conventional approach of realizing beamforming networks by using an array of phase shifting elements is currently not practical in many wideband millimeter wave phased array antenna systems.

An antenna beamforming network for phased array antenna systems operative at radio frequencies has been developed without the utilization of phase shifting elements. Specifically, in the August, 1963 issue of *Microwaves*, page 82, J. McFarland and J. Ajioka disclose a true time delay, multiple-beam, constrained lens for feeding a planar antenna array. True time delay antenna beamforming networks are ostensibly realized without employing phase shifting elements. As a result, in an antenna system having a true time delay beamforming network, the resultant beam direction is independent of frequency variation. It follows that true time delay beamforming networks are well suited for inclusion in wideband antenna systems.

Unfortunately, a direct millimeter wave implementation of the true time delay beamforming network of McFarland-Ajioka poses a number of difficulties. For example, the Mcfarland-Ajioka beamforming network includes a number of transmission cables. At millimeter wavelengths, transmission cables typically introduce appreciable loss and are bandwidth limiting. It follows that in a millimeter wave version of the McFarland-Ajioka beamforming network, the lengths of transmission cables must be minimized. However this minimization of cable length inhibits mechanical flexibility by constraining elements within the McFarland-Ajioka beamforming network to be in close physical proximity. Limitations on mechanical flexibility may prevent inclusion of the beamforming network in certain airborne and conformal array applications and may compound heat dissipation problems. It follows that in certain applications a practical realization of the antenna array feed beamforming network disclosed by McFarland and Ajioka is effectively precluded, at millimeter wavelengths, by transmission cable loss characteristics and concomitant cable length requirements.

Hence, a need exists in the art for a wideband, true time delay beamforming network for millimeter wave phased array antennas.

SUMMARY OF THE INVENTION

The need in the art for a wideband, true time delay beamforming network for millimeter wave phased array antennas is addressed by the antenna beamforming network of the present invention. The beamforming network of the present invention includes a laser for generating a beam of electromagnetic energy. The beamforming network further includes a modulator for modulating the beam in response to an input signal. A first antenna generates a first electromagnetic field pattern by radiating the modulated beam in a first direction. The present invention further includes a constrained lens for receiving the first field pattern and for emitting an antenna driver feed beam in a second direction in response thereto. An antenna array driver electromagnetically coupled to the constrained lens by the feed beam provides a set of signals modulated about the first frequency to drive an antenna array.

BRIEF DESCRIPTION OF THE DRAWINGS

FIG. 2 shows a cross sectional view of a spherical mirror illuminated by an optical point source.

FIG. 3 is an illustrative top view of a transmit/-receive module of the antenna array driver included within the beamforming network of the present invention.

DETAILED DESCRIPTION OF THE INVENTION

Figure 1:
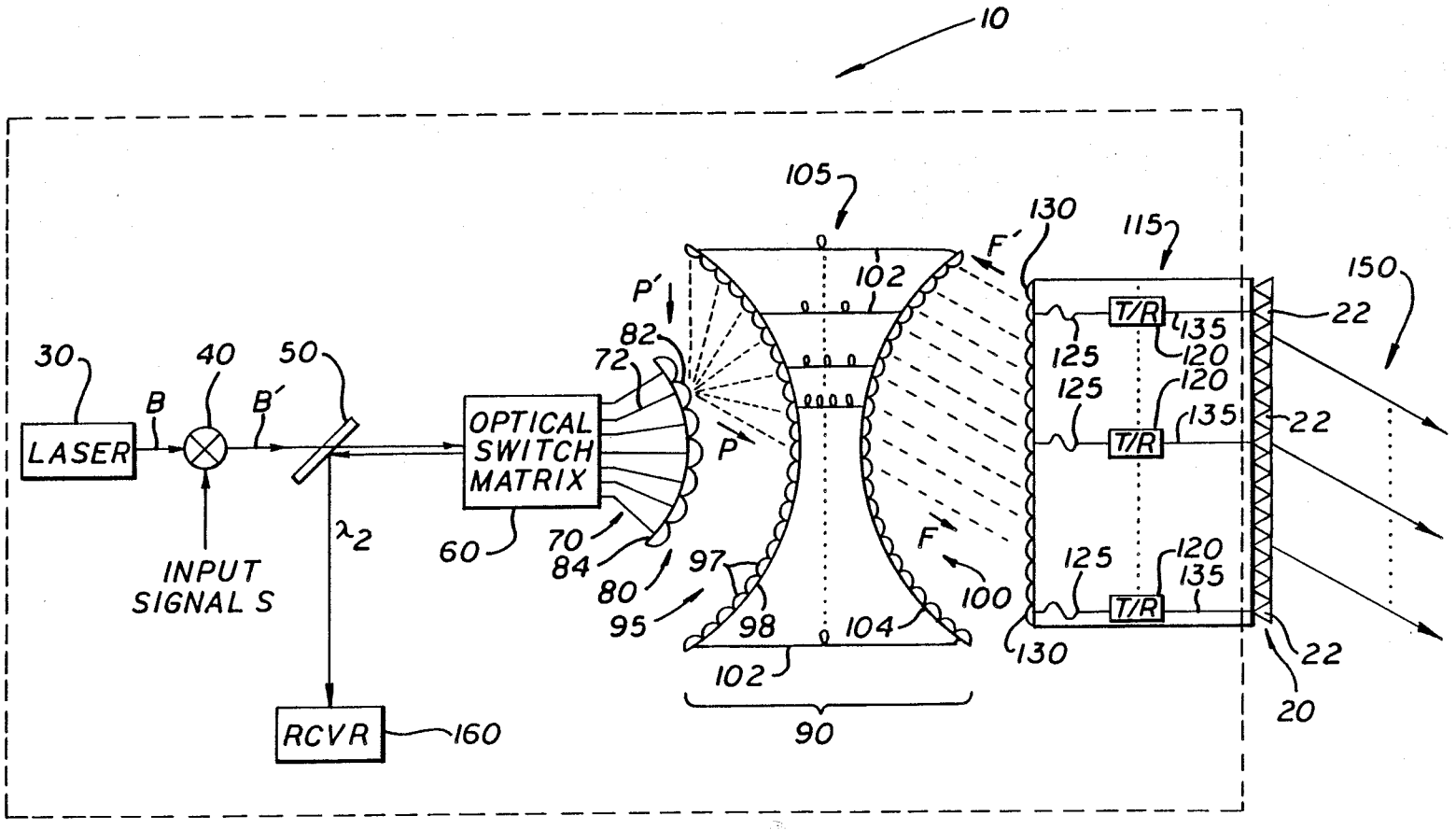
FIG. 1 is a combination block-circuit diagram partially in cross section of an illustrative embodiment of the antenna beamforming network of the present invention.

FIG. 1 is a combination of a block and circuit diagram, partially in cross section of an illustrative embodiment of the antenna beamforming network 10 of the present invention. As is discussed below, in a transmit mode the beamforming network 10 is operative to drive a planar phased array antenna 20 with a set of signals in response to an input signal S. In the embodiment of FIG. 1 the input signal S is centered about a millimeter wave frequency $f_o$, it being understood that the invention is not limited to operation within a particular frequency spectrum. The beamforming network 10 includes a substantially monochromatic laser 30 which provides an optical laser beam B. The laser beam B is modulated by the input signal S by an electro-optic modulator 40 to provide a modulated optical beam B'. The beam B' is passed by a first dichroic beam splitter 50 to an optical switch matrix 60. The switch matrix 60 is coupled to an array of optic fibers 70 and routes the beam B' to one of the fibers included therein in response to a signal from a system controller (not shown). The array of fibers 70 links the matrix 60 with a convex, substantially spherical array of optical radiating elements 80.

In the particular embodiment of FIG. 1, the matrix 60 routes the beam B' to a fiber 72 which feeds an optical radiating element 82. The element 82 radiates the beam B' in an optical field pattern P to feed a constrained lens 90. The field pattern P is received by a first concave, spherical array of optical radiating elements 95 included within the lens 90. The first array of radiating elements 95 is optically coupled to a second concave, spherical array of optical radiating elements 100 by an array of optical fibers 105.

The second array of optical radiators 100 emits an optical feed beam F in response to the optical field pattern P received by the first array of optical radiators 95. The feed beam F is received by a combination frequency conversion, phase correction antenna array driver 115. The antenna array driver 115 supplies a set of signals, sequentially phase shifted about the frequency $f_o$, to the antenna array 20 in response to the feed beam F. The antenna array 20 radiates the set of signals supplied thereto to form an output beam 150 centered about the millimeter wave frequency $f_o$ and having a direction substantially identical to the direction of the feed beam F.

As may be evident from the above, a feature of the present invention is that the beamforming network 10 is disposed to drive the phased array antenna 20 without utilizing phase shifting elements. Millimeter wave phase shifters are generally lossy, bandwidth limiting and illsuited for inclusion in wideband antenna systems. The beamforming network 10 is a true time delay beamforming network wherein the direction of the output beam 150 is optically controlled by selecting a particular optical radiator in the array 80 to be energized by the beam B'. In this manner the present invention is adapted for inclusion in wideband, scanning phased array millimeter wave antenna systems.

In the embodiment of FIG. 1 the laser beam B is provided by the conventional, monochromatic laser 30. Although in FIG. 1 the input signal S modulates the beam B via the electro-optic modulator 40, suitable high-speed semiconductor lasers may be substituted for the laser 30 and directly modulated by the input signal S. Nonetheless, in the embodiment of FIG. 1, the conventional electro-optic modulator 40 is directly illuminated by the beam B and modulates the intensity thereof in response to the input signal S to form the beam B'.

The first dichroic beam splitter 50 allows the beamforming network 10 to simultaneously operate in transmit and receive modes, each mode being supported by optical beams of a particular wavelength. That is, the first dichroic beam splitter 50 is operative to pass the transmit mode beam B' of a first wavelength to the matrix 60 and to redirect receive mode optical beams of a second wavelength from the matrix 60 to an optical receiver 160. The first dichroic beam splitter 50 may be realized by a conventional dichroic beam splitter adapted to operate at the first and second optical wavelengths.

The switch matrix 60 includes a tree-like array of conventional electro-optic switches interconnected by an optic fiber transmission line. Individual $1\times4$ or $1\times8$ branches are commercially available and may be appropriately concatenated to provide a link to each of the optic fibers within the array 70. A system controller (e.g. a digital computer, not shown) may be programmed to actuate the electro-optic switches within the matrix 60 as necessary to guide the beam B' to a selected optic fiber within the array 70. In this manner, the switch matrix 60 determines the direction of the field pattern P by controlling which of the optical radiators within the array 80 emits the beam B+.

In the alternative an optical divider (beam splitter) may be placed at each optical path junction within the matrix 60 to allow a portion of the beam B' to address an electro-optic switch coupled to each of the optic fibers within the array 70. In this manner, a number of the optical radiators within the array 80 may be energized simultaneously which enables the antenna array 20 to simultaneously emit multiple millimeter wave output beams. Similarly, the capability of energizing a cluster of the optical radiators within the array 80 affords increased output beam directional flexibility.

In the embodiment of FIG. 1, the array of optical radiating elements 80 is realized by terminating each of the optic fibers within the array 70 with an optical lens. The lenses are chosen such that the field pattern P emitted thereby illuminates a desired portion of the first concave array of radiators 95. Those skilled in the art may be aware of other optical elements suitable for radiating the beam B' to form the optical field pattern P. The array of radiators 80 is mounted by securing the optic fibers within the array 70 to a suitably supportive, convex spherical member 84.

The first and second concave arrays of radiating elements 95 and 100 are arranged in a periodic lattice having an element spacing of approximately one half of the wavelength of the input signal S. This particular element spacing is chosen to effectively prevent the formation of grating lobes. The first and second concave arrays of radiating elements 95 and 100 each include optical lenses 97 inserted at both ends of each of a plurality of optic fibers 102. Each lens within the arrays 95 and 100 provides a wide angle illumination/-receive pattern while operating in the transmit/receive mode. Further, the fibers 102 are suspended between suitably supportive, concave spherical members 98 and 104. Hence, it is seen that the constrained lens 90 is "constrained" in the sense that optical energy propagating between the members 98 and 104 is confined to the optic fibers 102.

FIG. 2 shows a cross sectional view of a spherical mirror M and an optical point source X intended to demonstrate the principle underlying the relative placement of the convex radiating element 80 and first and the second concave arrays of radiating elements 95 and 100. As shown in FIG. 2, the point source X is positioned on the locus L of foci of the spherical mirror M. Optical energy from the point source X is reflected by a segment T of the mirror to form an approximate plane wave W. Similarly, as shown in FIG. 1, the relative positioning of the convex array 80 and the first concave array 95 is substantially identical to the relative positioning between the locus L and the mirror M in FIG. 2. Accordingly, if the mirror M were substituted for the first concave array 95 in FIG. 1, a plane wave would be reflected thereby upon illumination by the radiator 82.

Instead, the first and second concave arrays 95 and 100 serve to generate an approximate plane wave in the form of the feed beam F following the illumination of the first concave array 95 by the field pattern P. The plane wave orientation of the feed beam F is effected by preserving the phase of the field pattern P upon transmission to the second concave array 100 subsequent to reception by the first concave array 95. This phase preservation is achieved by using equal length optic fibers 102 to couple corresponding optical radiators within the first and second concave arrays 95 and 100. The optical feed beam F is an approximate rather than an exact plane wave as a consequence of the spherical rather than parabolic surfaces of the first and second concave arrays 95 and 100. Further, the positions of the radiators within the convex array 80 may be slightly displaced from a spherical arrangement to partially compensate for phase errors within the feed beam F engendered by this finite optical radiator spacing.

As is known from fundamental optics principles, the direction of the plane wave W in FIG. 2 may be varied by moving the point source X along the locus L. Accordingly, by analogy, each optical radiator within the convex array 80 of FIG. 1 corresponds to a separate direction of the optical feed beam F. It follows that the locations of the optical radiating elements within the array 80 are determined by the desired directions of the optical feed beam F and corresponding millimeter wave output beam.

As mentioned above, the optical feed beam F is received by the combination frequency conversion, phase correction antenna array driver 115. As shown in FIG. 1 the array driver 115 includes a plurality of transmit/-receive modules 120. Each of the modules 120 may be coupled to an individual millimeter wave radiating element 22 or to a subarray thereof. The array driver 115 further includes a plurality of optical radiators 130, each of the radiators 130 being coupled to one of the modules 120 via an optic fiber correction line 125. The radiators 130 receive the optical feed beam F of the first optical wavelength and transmit an optical feed beam F′ of the second optical wavelength. The respective lengths (delays) of the optic fibers 125 are adjusted as a function of the location of the optical radiator 130 coupled thereto in order to partially compensate for the phase aberrations of the feed beam F caused by the spherical arrays 95 and 100. It is not necessary to independently adjust the delay (insertion phase) of the correction lines 125 for the different directions of the feed beam F due to the spherical symmetry of the constrained lens 90. The particular phase errors of the feed beam F may be discerned by one skilled in the art through, for example, appropriate measurements of the resultant millimeter wave output beam.

FIG. 3 is an illustrative top view of a transmit/-receive module 120 and the optical radiator 130, optic fiber 125 and millimeter wave radiator 22 coupled thereto. As shown in FIG. 3, the portion of the optical feed beam F received by the optical radiator 130 is transmitted by the optic fiber 125 to the module 120. The fiber 125 is secured to a dielectric (e.g. alumina) mounting substrate 122 and is terminated by an optical lens 127. The lens 127 illuminates a second dichroic beam splitter 129 with optical energy of the first wavelength from the feed beam F. The second dichroic beam splitter 129 may be positioned as shown in FIG. 3 to transmit optical energy of the first wavelength and to redirect optical energy of the second wavelength. In this manner the second beam splitter 129 serves as a diplexer allowing the optic fiber 125 to simultaneously carry optical signals corresponding to the transmit and receive modes.

The terminating lens 127 of the optic fiber 125 is positioned in optical alignment with a photodiode 131. Accordingly, the photodiode is illuminated by the portion of the feed beam received by the optical radiator 130. The envelope of the modulating light illuminating the photodiode 131 is detected thereby and utilized to recover the input millimeter wave signal S centered about the frequency $f_o$. The photodiode 131 is mounted on the substrate 122 and is of sufficiently high speed to respond to the frequency $f_o$.

The recovered input signal S is transmitted from the photodiode 131 by a signal line 132 to a high power amplifier 133. A plurality of signal lines 132, 134, 135, 136, 137 and 138 may be realized by microstrip transmission lines photo-lithographically printed on the substrate 122. The amplifier 133 is mounted on the substrate 122 and has a passband centered about the frequency $f_o$. The amplifier 133 is coupled to a conventional three port circulator 140 by the signal line 134. The circulator 140 passes the amplified millimeter wave signal from the amplifier 133 to a millimeter wave radiating element 22 coupled to the signal line 135. In addition, in the receive mode the circulator 140 routes millimeter wave signals received by the radiating element 22 to the signal line 136. The circulator 140 is mounted directly on the substrate 122 and is commercially available from vendors including Hughes Millimeter Wave Products Division located in Torrance, Calif.

Aside from the relatively small length differences in the optic fiber connection lines 125 included within the array driver 115, the propagation delays of all signal paths through the array driver 115 are approximately equal. It follows that the wavefront phase of the optical feed beam F is preserved upon frequency conversion within the array driver 115. Accordingly, the antenna array driver 115 supplies a set of sequentially phase shifted versions of the input signal S on the signal lines 135 to the antenna array 20 in response to the feed beam F. The antenna array 20 radiates the set of signals supplied thereto to form an output beam 150 centered about the millimeter wave frequency $f_o$.

The millimeter wave radiating elements 22 within the antenna array 20 typically include microstrip elements printed on high dielectric constant substrates. Examples of suitable microstrip radiators are patch, cross dipole and dielectric loaded cavity elements. In FIG. 1 and in FIG. 3, a single radiating element 22 is coupled to each transmit/receive module 120. In the alternative a single module 120 is coupled to a subarray of radiating elements 22. Such alternatives are typically more economical as the number of transmit/receive modules 120 may be substantially reduced.

In the receive mode, millimeter wave signals received by the radiating element 22 routed to the signal line 136 are passed through a limiter 142. The limiter 142 is used to protect a generally sensitive low noise amplifier 143 from large amplitude electromagnetic energy received by the radiating element 22.

The limiter 142 is coupled to the millimeter wave low noise amplifier 143 by the signal line 137. The passband of the low noise amplifier 143 is chosen such that only signals modulated about the frequency $f_o$ are amplified. The low noise amplifier 143 will typically include either one or two temperature compensated, low noise field effect transistors mounted directly on the substrate 122. The amplifier 143 drives a laser diode 144 coupled thereto by the signal line 138. The light energy emitted by the laser diode 144 is at the second optical wavelength and is intensity modulated by the millimeter wave signal provided by the amplifier 143. The modulated optical beam generated by the photodiode 144 is coupled to the optic fiber 145 by an optical lens 146. In an alternative, the amplifier 143 is coupled to an electro-optic modulator (not shown) positioned in optical alignment with the laser diode 144 and the lens 146. The electro-optic modulator modulates the intensity of the optical beam provided by the laser diode 144 with the millimeter wave signal from the amplifier 143.

The optic fiber 145 emits the modulated optical beam provided by the laser diode 144 at an optical lens 147. The beam emitted by the lens 147 is at the second optical wavelength and is therefore redirected by the second dichroic beam splitter 129 to the lens 127. In this manner the transmit/receive modules 120 included within the array driver 115 enable the antenna array 20 to simultaneously operate in transmit and receive modes. In the transmit mode, the phase of the optical feed beam F is preserved upon conversion to the millimeter wave output beam 150 by the array driver 115 and antenna array 20. That is, in the transmit mode the array driver 115 is operative to generate a plurality of sequentially phase shifted versions of the input signal S on the lines 135 in response to the phase of the optical feed beam F.

Operation of the beamforming network 10 of the present invention in the receive mode is substantially reciprocal to that of the transmit mode described above. Briefly, referring to FIG. 1, a millimeter wave beam having a signal centered about the frequency $f_o$ is received by the antenna array 20 and converted to an optical beam F′ of the second optical wavelength by the array driver 115. The beam F′ is received by the second concave array of optical radiators 100 and transmitted, phase intact, by the array of optic fibers 105 to the first concave array of optical radiators 95. The first concave array of optical radiators 95 generates an optical field pattern P′ at the second optical wavelength in response to the beam F′. The field pattern P′ is focused on the optical radiator 82 and collected thereby. The optical energy collected by the radiator 82 is routed through the switch matrix 60 and redirected by the first dichroic beam splitter 50 to a receiver 160.

The receiver 160 includes a photodiode (not shown) to extract the millimeter wave signal centered about the frequency $f_o$ from the optical beam illuminating the receiver 160. The particular region within the field of view of the antenna 20 from which a millimeter wave signal beam is to be received is selected by configuring the switch matrix 60 to allow optical communication between a desired radiator within the array 80 and the receiver 160. In this manner the beamforming network 10 of the present invention is disposed to scan the field of view of the antenna 20 by successively selecting radiating elements within the array 80 via the matrix 60.

Millimeter wave transmission cables increase the loss and decrease the mechanical flexibility and bandwidth of conventional millimeter wave phased array antenna systems. In contrast, the optic fiber transmission lines utilized within the embodiment of the present invention shown in FIG. 1 are neither lossy nor bandwidth limiting. It is therefore a feature of the present invention that these optic fibers may be lengthened to enhance mechanical flexibility without introducing appreciable loss. For example, the optic fiber correction lines 125 may be lengthened to allow the antenna array 20 to be displaced from the remainder of the beamforming network 10. Similarly, the optic fibers 102 may be folded to allow the first and second arrays of radiators 95 and 100 within the constrained lens 90 to be positioned in a more compact arrangement.

Thus the present invention has been described with reference to a particular embodiment in connection with a particular application. Those having ordinary skill in the art and access to the teachings of the present invention will recognize additional modifications and applications within the scope thereof. For example, those skilled in the art may modify the present invention for dual band operation by using wavelength division multiplexing. Similarly, the invention is not limited to the particular optical and millimeter wavelength components disclosed herein. Those skilled in the art may adapt the present invention for operation at other wavelengths without departing from the scope thereof. In addition, arrays of radiating elements of other suitable shapes and element patterns may be appropriate for inclusion in alternative embodiments of the present invention.

It is therefore contemplated by the appended claims to cover any and all such modifications.

Accordingly,

What is claimed is:

1. A transmit antenna beamforming network comprising:

means for generating a beam of optical energy;

modulating means for modulating said beam of optical energy in response to an input signal modulated about a first frequency;

radiating means for generating a first electromagnetic field pattern by radiating said modulated beam in a first direction;

constrained lens means including a first array of radiating elements for receiving said first field pattern and a second array of radiating elements for emitting an antenna driver feed beam in a second direction in response thereto;

antenna array driving means electromagnetically coupled to said constrained lens means by said feed beam for providing a set of signals modulated about said first frequency; and antenna array means for radiating an electromagnetic scan beam modulated about said first frequency substantially in said second direction in response to said set of signals.

2. The transmit antenna beamforming network of claim 1 wherein said constrained lens means includes means for providing first and second concave surfaces for mounting said first and second arrays of radiating elements.

3. The transmit antenna beamforming network of claim 2 wherein said first and second concave surfaces are spherically shaped.

4. The transmit antenna beamforming network of claim 1 wherein said constrained lens means further includes interconnecting means for electro-magnetically coupling said first and second arrays of radiating elements.

5. The transmit antenna beamforming network of claim 4 wherein said interconnecting means includes a first number of transmission lines for electro-magnetically coupling each of said radiating elements within said first array to a corresponding radiating element within said second array.

6. The transmit antenna beamforming network of claim 5 wherein each of said transmission lines is of equal length.

7. The transmit antenna beamforming network of claim 1 wherein each of said first and second arrays includes a first number of radiating elements.

8. The transmit antenna beamforming network of claim 1 wherein said radiating means includes a plurality of radiating elements.

9. The transmit antenna beamforming network of claim 8 wherein said plurality of radiating elements are distributed on a convex, spherical surface positioned concentrically relative to said first concave surface.

10. The transmit antenna beamforming network of claim 1 further including matrix switching means for coupling at least a portion of said modulated beam to at least one of said radiating elements of said radiating means.

11. The transmit antenna beamforming network of claim 10 wherein said modulating means includes an electro-optic modulator positioned between said beam generating means and said matrix switching means.

12. The transmit antenna beamforming network of claim 1 wherein said antenna array driving means includes a photodiode coupled to an amplifier, said amplifier being in electrical communication with said antenna array means.

13. A phased array transmit antenna system comprising:

means for generating a beam of optical energy;

modulating means for modulating said beam of optical energy in response to an input signal modulated about a first frequency;

first antenna means for generating a first electromagnetic field pattern by radiating said modulated beam in a first direction;

constrained lens means including a first array of radiating elements for receiving said first field pattern and a second array of radiating elements for emitting an antenna driver feed beam in a second direction in response thereto, said constrained lens means further including means for providing first and second concave surfaces for mounting said first and second arrays of radiating elements;

matrix switching means in communication with said modulating means for coupling at least a portion of said modulated beam to at least one of a plurality of radiating elements of said first antenna means;

antenna array driving means electromagnetically coupled to said constrained lens means by said feed beam for providing a set of signals modulated about a first frequency; and antenna array means for radiating an electromagnetic scan beam modulated about a first frequency substantially in said second direction in response to said set of signals.

14. The transmit antenna system of claim 13 wherein said constrained lens means further includes interconnecting means for electromagnetically coupling said first and second arrays of radiating elements.

15. The transmit antenna system of claim 13 wherein said first and second concave surfaces are spherically shaped and wherein said first antenna means includes a plurality of radiating elements distributed on a convex, spherical surface positioned concentrically relative to said first concave surface.

16. The transmit antenna system of claim 13 wherein said antenna array driving means includes a photodiode coupled to an amplifier, said amplifier being in electrical communication with said antenna array means.

17. A receive antenna array system comprising:

receiving antenna array means for receiving an input electromagnetic beam of a first direction modulated by a signal;

constrained lens driving means for emitting a first optical beam substantially in said first direction in response to said input beam, said first beam carrying said signal;

constrained lens means for receiving said first optical beam and for radiating an electromagnetic field pattern in a second direction in response thereto, said field pattern being focused on a focal plane;

combining antenna means positioned in said focal plane for receiving said field pattern for forming a second optical beam carrying said signal; and receiving means operatively coupled to said first antenna means for extracting said signal from said second optical beam.

18. A dual mode transmit/receive antenna beamforming network/combiner comprising:

means for generating a first beam of optical energy of a first wavelength;

modulating means for modulating said first beam of optical energy in response to a transmit signal modulated about a first frequency;

first antenna means for generating a first electromagnetic field pattern by radiating said modulated first beam in a first direction and for receiving a second electromagnetic field pattern of a second wavelength to form a second optical beam of said second wavelength;

constrained lens means in communication with said first antenna means and including a first array of radiating elements for receiving said first field pattern and a second array of radiating elements for emitting a transmit feed beam in a second direction in response thereto and further for generating said second field pattern in response to a receive feed beam having said second wavelength;

matrix switching means in communication with said first antenna means for coupling at least a portion of said modulated beam to at least one of a plurality of radiating elements of said first antenna means;

antenna array driving means electromagnetically coupled to said constrained lens means by said transmit and receive feed beams for providing a set of signals modulated about said first frequency for driving an antenna array in response to said transmit feed beam and for generating said receive feed beam in response to an input electromagnetic beam modulated about said first frequency received by said antenna array;

beam splitting means in electromagnetic communication with said first antenna means for separating said second optical beam and said modulated first beam; and receiving means coupled to said first antenna means by said second optical beam for extracting a receive signal from said second optical beam.

* * * * *

UNITED STATES PATENT AND TRADEMARK OFFICE

CERTIFICATE OF CORRECTION

PATENT NO. : 4,929,956

DATED : May 29, 1990

INVENTOR(S) : Jar J. Lee, et. al.

It is certified that error appears in the above-indentified patent and that said Letters Patent is hereby corrected as shown below:

Column 9, line 24, after the word "surface", insert --of said constrained lens means--.

Signed and Sealed this

Ninth Day of November, 1993

*Attest:*

*Attesting Officer*

BRUCE LEHMAN

*Commissioner of Patents and Trademarks*